US008936484B2

(12) United States Patent
Metzler et al.

(10) Patent No.: US 8,936,484 B2
(45) Date of Patent: Jan. 20, 2015

(54) HIGH VOLTAGE CONNECTOR INTERFACES

(71) Applicant: Hamilton Sundstrand Corporation, Windsor Locks, CT (US)

(72) Inventors: Mark W. Metzler, Davis, IL (US); Eric A. Carter, Monroe, WI (US); Randy P. Gauvin, Beloit, WI (US); Michael Sapron, Rockford, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 177 days.

(21) Appl. No.: 13/632,523

(22) Filed: Oct. 1, 2012

(65) Prior Publication Data

US 2014/0094060 A1 Apr. 3, 2014

(51) Int. Cl.
*H01R 13/60* (2006.01)
*H01R 13/52* (2006.01)

(52) U.S. Cl.
CPC ..... *H01R 13/60* (2013.01); *H01R 13/5221* (2013.01)
USPC ..... 439/569

(58) Field of Classification Search
CPC . H01R 13/6215; H01R 13/60; H01R 13/5221
USPC ..... 439/569, 564, 362, 573, 363
See application file for complete search history.

(56) References Cited

U.S. PATENT DOCUMENTS 2,294,738 A * 9/1942 Bruno ..... 174/22 C
2,421,780 A * 6/1947 Frear ..... 361/301.2
2,431,638 A * 11/1947 Goodchild et al. ..... 333/222
3,040,289 A * 6/1962 Wicks ..... 439/564
3,076,168 A * 1/1963 Keen ..... 439/279
3,086,074 A * 4/1963 Just et al. ..... 174/148
3,675,185 A * 7/1972 Ruehlemann et al. ..... 439/564
4,113,179 A * 9/1978 McKee ..... 439/354
4,676,575 A 6/1987 Denlinger et al.
4,684,190 A 8/1987 Clark et al.
4,767,350 A * 8/1988 Cooper et al. ..... 439/271
4,778,411 A 10/1988 Rudy, Jr. et al.
4,889,502 A 12/1989 Althouse et al.
4,929,184 A * 5/1990 Emadi et al. ..... 439/681
4,934,950 A * 6/1990 Green et al. ..... 439/681

(Continued)

FOREIGN PATENT DOCUMENTS

EP 2369691 A1 9/2011

OTHER PUBLICATIONS

Extended European Search Report, dated Feb. 10, 2014, for European Patent Application No. 13183891.4, 11 pages.

*Primary Examiner* — Amy Cohen Johnson
*Assistant Examiner* — Vladimir Imas
(74) *Attorney, Agent, or Firm* — Kinney & Lange, P.A.

(57) ABSTRACT

An electrical connector interface comprises a plug connector assembly, a receptacle connector assembly, and an anti-rotation fastener receiving post. A plurality of spaced apart conductive contact sockets each have a mating end retained in a monolithic mating portion of a nonconductive plug connector shell body. A plurality of spaced apart conductive contact pins extend into a mating portion of a nonconductive receptacle connector shell body. The nonconductive plug and receptacle connector shell bodies each have an external mounting flange with a anti-rotation aperture. The anti-rotation fastener post has a first anti-rotation end insertable into either the plug anti-rotation aperture or the receptacle anti-rotation aperture.

21 Claims, 12 Drawing Sheets

(56) References Cited

U.S. PATENT DOCUMENTS

| | | | | | |
|---|---|---|---|---|---|
| 5,007,862 | A * | 4/1991 | Defibaugh et al. | 439/607.59 |
| 5,288,244 | A * | 2/1994 | Lien | 439/362 |
| 5,391,091 | A * | 2/1995 | Nations | 439/378 |
| 5,473,510 | A * | 12/1995 | Dozier, II | 361/719 |
| 5,588,858 | A * | 12/1996 | Lester et al. | 439/275 |
| 5,836,787 | A * | 11/1998 | Kodama | 439/567 |
| 6,116,942 | A * | 9/2000 | Chen et al. | 439/362 |
| 6,273,742 | B1 * | 8/2001 | Castagna et al. | 439/362 |
| 6,305,961 | B1 * | 10/2001 | Szilagyi et al. | 439/271 |
| 6,358,075 | B1 * | 3/2002 | Tischner | 439/248 |
| 6,447,332 | B1 * | 9/2002 | Djian | 439/564 |
| 6,469,905 | B1 * | 10/2002 | Hwang | 361/756 |
| 6,471,543 | B1 * | 10/2002 | Balcombe et al. | 439/565 |
| 6,802,734 | B2 * | 10/2004 | Wu | 439/362 |
| 6,860,751 | B1 * | 3/2005 | Huang | 439/362 |
| 6,929,501 | B2 * | 8/2005 | Huang | 439/362 |
| 7,393,228 | B2 * | 7/2008 | Kabasawa et al. | 439/247 |
| 7,500,865 | B2 * | 3/2009 | Natter et al. | 439/362 |
| 7,559,796 | B1 * | 7/2009 | Wu | 439/564 |
| 7,607,930 | B1 * | 10/2009 | Wu | 439/247 |
| 7,614,897 | B2 * | 11/2009 | Lopez | 439/248 |
| 7,713,087 | B2 * | 5/2010 | Kabasawa et al. | 439/606 |
| 7,950,942 | B2 * | 5/2011 | Klinger et al. | 439/247 |
| 8,672,706 | B2 * | 3/2014 | Matsumoto et al. | 439/489 |
| 2007/0202733 | A1 | 8/2007 | Rose et al. | |

* cited by examiner

HIGH VOLTAGE CONNECTOR INTERFACES

BACKGROUND

The described subject matter relates generally to interconnection of electrically operated components and more specifically to interfaces for electrically operated components.

Older electrical connector systems were designed for lower direct current (DC) and alternating current (AC) voltages. For example, previous aircraft electrical systems operate at either nominal 28 VDC or 115 Vrms. Newer systems and components are being developed with increased voltages. Newer aircraft are also capable of sustained flight at higher elevations. However, higher operating voltages and lower atmospheric pressures increase the likelihood of corona, arcing, and dielectric breakdown.

The current approach is to adapt existing lower voltage connector interfaces by removing one or more contacts from the interface, leaving several apertures empty to meet the required dielectric and corona spacing to prevent arcing between adjacent contacts or between a contact and a metal connector shell. To meet environmental design requirements for humidity and salt-fog ingress, these open contact spaces must often be filled with a nonconductive material. Even so, the resulting connector has a large footprint and low power density, requiring the addition of more wiring, interfaces, and other circuitry to manage the increasing complexity of current and future aircraft electrical systems.

SUMMARY

An electrical connector interface comprises a plug connector assembly, a receptacle connector assembly, and an anti-rotation fastener receiving post. The plug connector assembly includes a plurality of spaced apart conductive contact sockets, each having a mating end retained in a monolithic mating portion of a nonconductive plug shell body. The nonconductive plug shell body has an external mounting flange with a plug anti-rotation aperture. The receptacle connector assembly includes a plurality of spaced apart conductive contact pins extending into a mating portion of a nonconductive receptacle shell body. Each conductive contact pin has a mating end configured to engage respective mating ends of the spaced apart plurality of conductive contact sockets. The nonconductive receptacle shell body has an external mounting flange with a receptacle anti-rotation aperture. The anti-rotation post has a first anti-rotation end insertable into either the plug flange or the receptacle flange.

A harness-type connector assembly comprises a nonconductive, monolithic shell body, a plurality of spaced apart contact apertures, and an anti-rotation aperture. The shell body includes a connector mating portion, a connector boot portion, and an external mounting flange. The contact apertures extend through the connector boot portion for retaining corresponding ones of a plurality of conductive crimp contacts. The anti-rotation aperture is formed through the external mounting flange. An inner mating side of the anti-rotation aperture is configured to receive a first anti-rotation end of an anti-rotation fastener receiving post.

A board-type connector assembly comprises a nonconductive, monolithic shell body, a plurality of spaced apart contact apertures, and an anti-rotation aperture. The shell body includes a connector mating portion, a standoff portion for spacing the connector mating portion apart from a substrate, and an external mounting flange. The plurality of spaced apart contact apertures extend through the shell body for retaining corresponding ones of a plurality of conductive tail contacts. The anti-rotation aperture is formed through the external mounting flange. An inner mating side of the anti-rotation aperture is configured to receive a first anti-rotation end of an anti-rotation fastener receiving post.

DETAILED DESCRIPTION

FIGS. 1A-1D show a family of electrical connector interfaces 10A, 10B, 10C, 10D, respectively. Each of interfaces 10A, 10B, 10C, 10D includes a plug connector assembly, a receptacle connector assembly, and an anti-rotation fastener post as explained below. FIGS. 1A-1D illustrate the four example interfaces 10A, 10B, 10C, 10D, which generally represent four possible combinations of one plug assembly and one receptacle assembly. The plug assembly can either be harness-type plug connector assembly 20A or board-type plug connector assembly 20B. The receptacle assembly can either be a board-type receptacle connector assembly 22A or a harness-type receptacle connector assembly 22B.

Figure 1A:
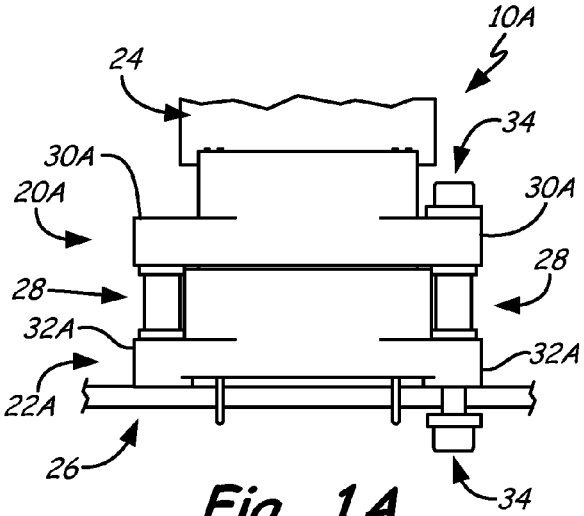
FIG. 1A schematically depicts a first example electrical connector interface.
Figure 1B:
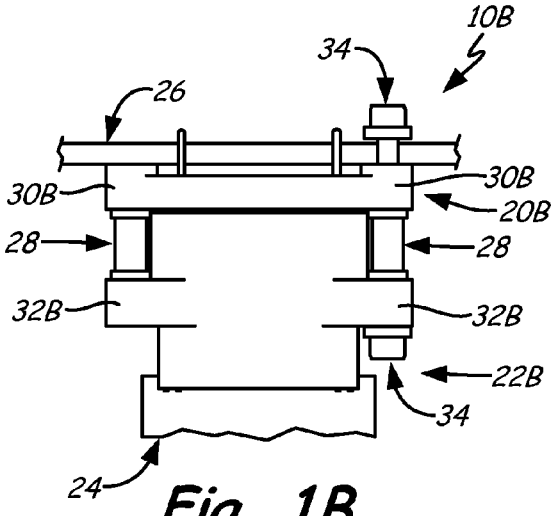
FIG. 1B shows a second example electrical connector interface.
Figure 1C:
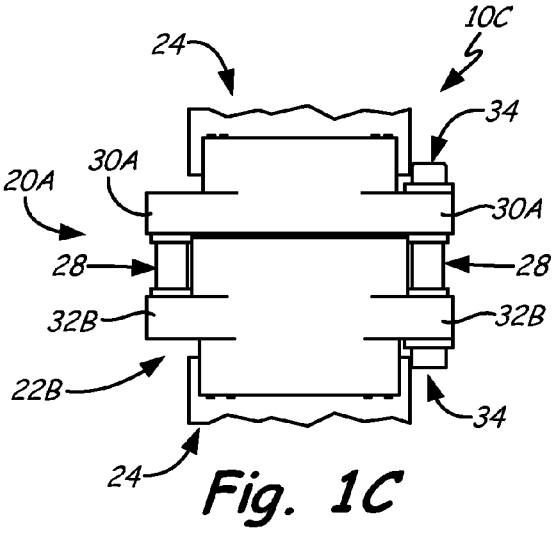
FIG. 1C is a third example electrical connector interface.
Figure 1D:
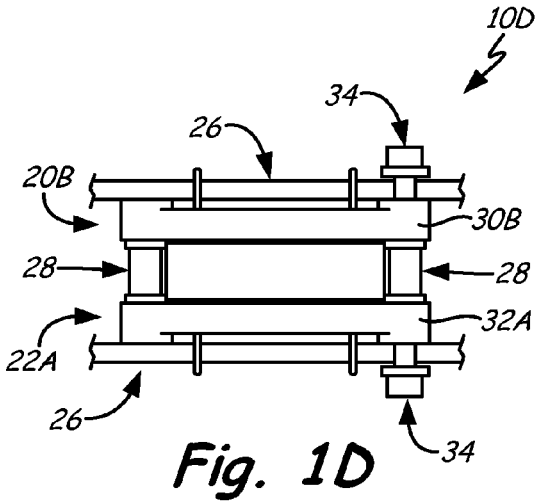
FIG. 1D depicts a fourth example electrical connector interface.

FIG. 1A includes first example interface 10A with harness-type plug connector assembly 20A, board-type receptacle connector assembly 22A, wire harness 24, printed wiring board 26, anti-rotation fastener post 28, plug mounting flanges 30A, receptacle mounting flanges 32A, and fasteners 34. FIG. 1B shows second example interface 10B with board-type plug connector assembly 20B, harness-type receptacle connector assembly 22B, wire harness 24, printed wiring board 26, anti-rotation fastener post 28, plug mounting flanges 30B, receptacle mounting flanges 32B, and fasteners 34. FIG. 1C depicts third example interface 10C with harness-type plug connector assembly 20A, harness-type receptacle connector assembly 22B, wire harnesses 24, anti-rotation fastener post 28, plug mounting flanges 30A, receptacle mounting flanges 32B, and fasteners 34. FIG. 1D shows fourth example interface 10D with board-type plug connector assembly 20B, board-type receptacle connector assembly 22A, printed wiring boards 26, plug mounting flanges 30B, receptacle mounting flanges 32A, and fasteners 34.

Electrical connector interfaces 10A, 10B, 10C, 10D each have at least one reversible anti-rotation fastener post 28 disposed between respective plug and receptacle mounting flanges 30A, 32A. Fasteners 34 engage opposing ends of anti-rotation fastener posts 28 through respective mounting flanges 30A, 32A to secure plug assembly 20A with receptacle assembly 22A without the need for external clamps.

Various embodiments of electrical interface assemblies 10A, 10B, 10C, 10D are suitable for normal minimum 200 V operation with minimal corona or direct dielectric breakdown at up to a standard 45,000 ft atmosphere. They can withstand surges of up to at least 1500V at maximum aircraft elevation. Compact spacing between conductive contacts (i.e. pins and sockets) can be maintained without removal of contacts from the contact apertures to prevent arcing. Thus they are suitable for newer 235 Vrms and 270 VDC aircraft electrical systems.

Following are details of the example embodiments of the electrical interface family 10A, 10B, 10C, 10D. Example interface 10A (shown in FIGS. 2A-2C) includes a harness-type plug connector assembly 20A (shown in FIGS. 3A-3B) and a board-type receptacle assembly 22A (shown in FIGS. 4A-4B). Example interface 10B (shown in FIG. 5) includes a board-type plug connector assembly 20B (shown in FIGS. 6A-6B) and a harness-type receptacle assembly 22B (shown in FIGS. 7A-7B). Example interface 10C (shown in FIG. 8A) includes a harness-type plug connector assembly 20A (shown in FIGS. 3A-3B) and a harness-type receptacle assembly 22B (shown in FIGS. 7A-7B). Example interface 10D (shown in FIG. 8B) includes a board-type plug connector assembly 20B (shown in FIGS. 6A-6B) and a board-type receptacle assembly 22A (shown in FIGS. 4A-4B). Each example is discussed in turn.

Figure 2A:
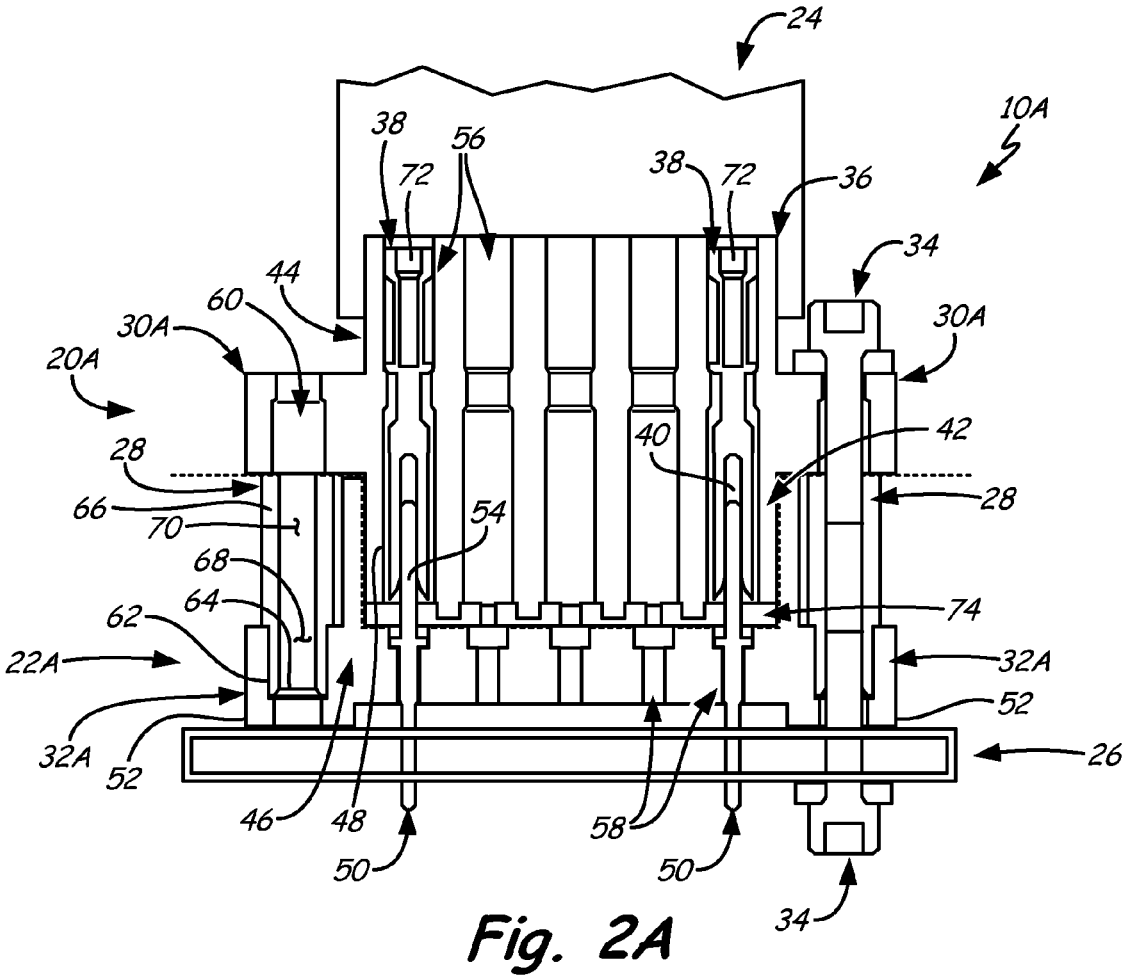
FIG. 2A shows a cross-section taken through a first member of the electrical connector interface family shown in FIG. 1A.

Example Interface 10A-Harness-Type Plug Connector and Board-Type Receptacle Connector FIG. 2A shows a transverse cross-section of example electrical connector interface 10A with harness-type plug connector assembly 20A, board-type receptacle connector assembly 22A anti-rotation fastener posts 28, and fasteners 34. FIG. 2A also includes plug harness 24, printed wiring board 26, plug mounting flanges 30A, receptacle mounting flanges 32A, harness-type plug shell body 36, electrically conductive crimp contact sockets 38, contact socket mating ends 40, plug connector mating portion 42, connector boot portion 44, board-type receptacle shell body 46, receptacle mating portion 48, electrically conductive tail contact pins 50, standoffs 52, contact pin mating ends 54, plug contact apertures 56, receptacle contact apertures 58, plug flange anti-rotation apertures 60, receptacle flange anti-rotation apertures 62, fastener post first receiving ends 64, fastener post second receiving ends 66, fastener post non-round external surface 68, fastener post round external surface 70, socket crimp ends 72, and face seal 74.

Plug assembly 20A generally includes nonconductive plug shell body 36 having at least one integrally molded external plug mounting flange 30A. A plurality of spaced apart, electrically conductive crimp contact sockets 38 have mating ends 40 retained in a monolithic plug mating portion 42 of nonconductive harness-type plug shell body 36. As a harness-type connector, plug shell body 36 can also include integrally molded plug connector boot portion 44 to shroud interconnections of sockets 38 with individual wires (not shown in FIG. 2A) in harness 24.

Receptacle assembly 22A generally includes nonconductive board-type receptacle shell body 46 with receptacle mating portion 48 configured to receive mating portion 42 of plug shell body 36. In this example, a plurality of spaced apart conductive tail contact pins 50 each have mating end 54 configured to engage respective mating ends 40 of the spaced apart plurality of conductive contact sockets 38. Tail contact pin mating ends 54 extend into mating portion 48 of receptacle shell body 46. As a board-type connector shell, receptacle shell body 46 can also include standoffs 52 to maintain separation of receptacle mating portion 48 from board 26. Conductive crimp contact sockets 38 and tail contact pins 50 are retained in contact apertures 56, 58 through respective shell bodies 36 and 46. External mounting flange 30A can have at least one plug anti-rotation aperture 60. Receptacle shell body 46 also can include at least one integrally molded external mounting flange 32A with receptacle anti-rotation aperture 62.

Anti-rotation fastener posts 28 can include first fastener receiving end 64 and opposing second receiving end 66. First receiving end 64 can have a non-round external surface 68 while second receiving end 66 can have round external surface 70. First anti-rotation fastener receiving end 64 is insertable into either plug mounting flange 30A or receptacle mounting flange 32A. Here, non-round external surface 68 is inserted into a non-round side of anti-rotation aperture 62 in receptacle mounting flange 32A from an inner mating side of receptacle flange 32A. As can be seen in the left side of FIG. 2A, plug mounting flange 30A also includes an anti-rotation aperture 60. Thus in certain embodiments, anti-rotation fastener posts 28 are reversible with first receiving end 64 having non-round external surface 68 alternatively inserted into non-round anti-rotation aperture 60 from the inner mating side of plug flange 30A. Each fastener receiving end 64, 66 of anti-rotation fastener posts 28 can be internally threaded to receive fasteners 34 for securing plug assembly 20A with receptacle assembly 22A.

For illustrative purposes, FIGS. 1A-1D and FIGS. 2A-2B show fasteners 34 on only one side of interface 10A. Similarly, FIGS. 2A-2B only shows two pairs of mated contact pins and sockets despite there being several contact apertures 56, 58 extending through both harness-type plug shell body 36 and board-type receptacle shell body 46. However, all of the contact apertures 56, 58 can each contain a respective contact pin or contact socket to maximize power density and minimize the footprint of connector interface 10A. Nonconductive harness-type plug shell body 36 and receptacle shell body 46 can each be monolithic temperature resistant thermoplastic or thermoset polymer, each with contact apertures 56, 58 therethrough to retain respective conductive crimp contact sockets 38 and tail contact pins 50. Corona and dielectric spacing can be further reduced by recessed socket crimp ends 72 and face seal 74 explained below.

Figure 2B:
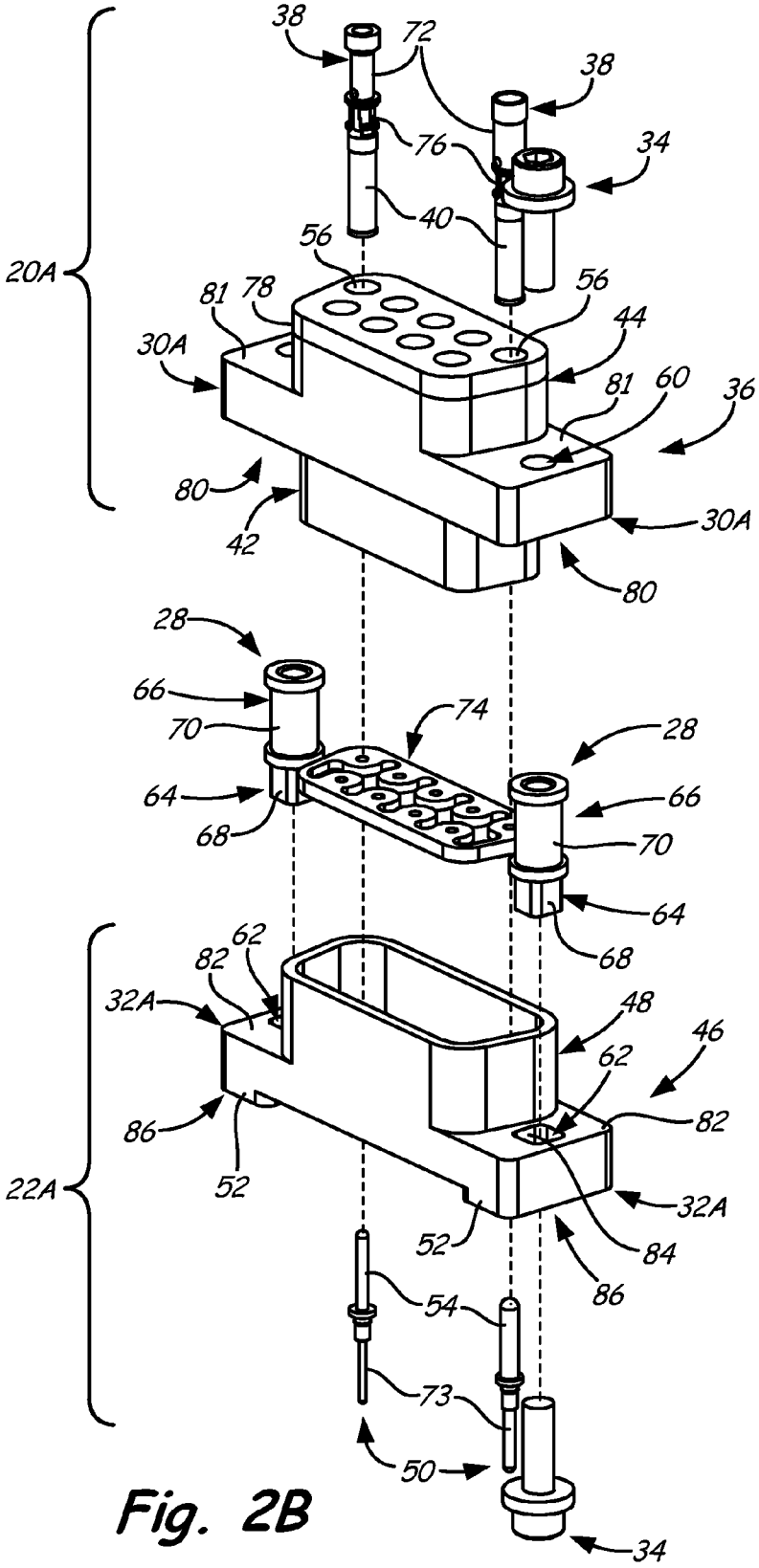
FIG. 2B is an exploded view of the first electrical connector interface of FIG. 1A.

FIG. 2B shows an exploded view of example electrical interface 10A with harness-type plug connector assembly 20A, board-type receptacle connector assembly 22A anti-rotation fastener posts 28, fasteners 34, and face seal 74. Harness-type plug connector assembly 20A also includes external plug mounting flanges 30A, nonconductive plug shell body 36, electrically conductive plug contact sockets 38, plug contact mating ends 40, plug mating portion 42, plug connector boot portion 44, plug contact apertures 56, plug anti-rotation apertures 60, contact socket crimp ends 72, integral retaining ring 76, sleeve retention ridge 78, plug flange mating sides 80, plug flange outer sides 81, and anti-rotation aperture portions 88. Board-type receptacle connector assembly 22A also includes receptacle mounting flanges 32A, nonconductive receptacle shell body 46, receptacle mating portion 48, standoffs 52, contact pin mating ends 54, receptacle anti-rotation apertures 62, contact pin tail ends 73, receptacle flange inner mating sides 82, anti-rotation aperture portion 84, and receptacle flange outer sides 86. Anti-rotation fastener posts 28 also include first fastener receiving ends 64, second fastener receiving ends 66, non-round external surface 68, and round external surface 70.

Figure 3A:
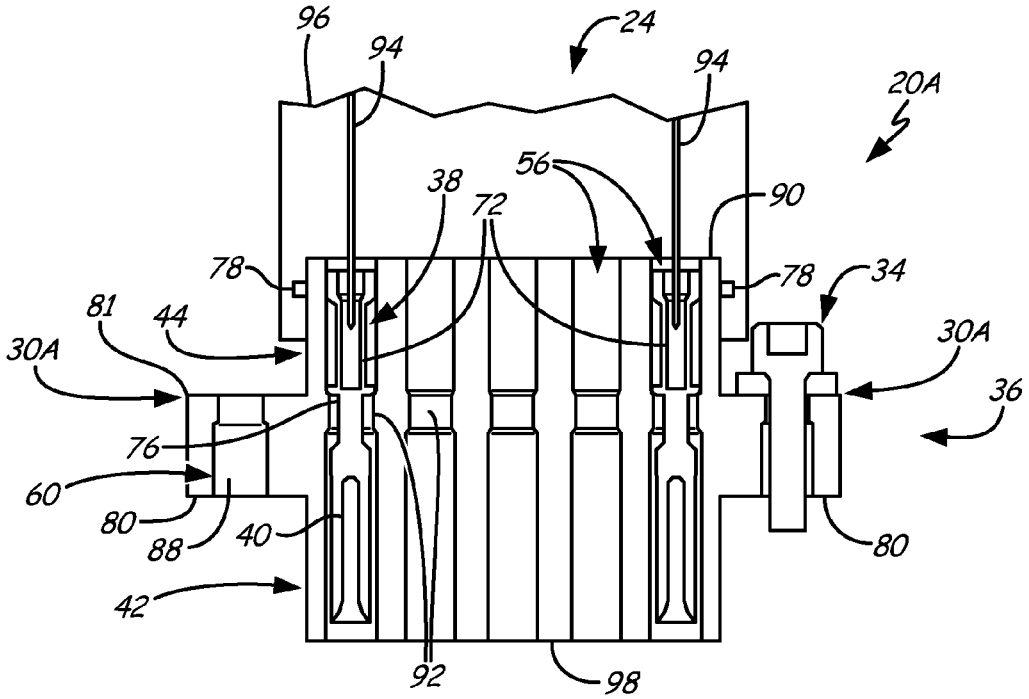
FIG. 3A is a cross-section of a harness-type plug connector assembly forming part of the interface shown in FIGS. 2A and 2B.

Harness type plug connector assembly 20A includes nonconductive harness-type plug shell body 36 having at least one integrally molded external plug mounting flange 30A and integrally molded connector boot portion 44 to help shroud interconnections of individual wires of harness 24 (shown in FIG. 3A) to contact sockets 38. In harness-type plug connector assembly 20A, plug contact apertures 56 extend through monolithic plug shell body 36, including plug mating portion 42 and plug connector boot portion 44. A plurality of spaced apart, electrically conductive crimp contact sockets 38 having mating ends 40 and crimp ends 72, are spaced apart and retained within plug contact apertures 56. Only two conductive crimp contact sockets 38 are shown in FIGS. 2A, 2B, and 3A; the remainder are omitted for clarity. Crimp contact sockets 38 can also optionally include integral retaining ring 76 to prevent movement of contact sockets 38 through apertures 56 once they are installed. Optional external sleeve retention ridge 78 can improve retention of a harness shrink-sleeve, shown in FIG. 3A, to connector boot portion 44.

Board-type receptacle connector assembly 22A includes nonconductive receptacle shell body 46 with receptacle mating portion 48 configured to receive mating portion 42 of plug shell body 36. Receptacle shell body 46 also can include at least one integrally molded external mounting flange 32A with standoffs 52 to maintain separation from board 26 (shown in FIG. 4A). In this example, a plurality of spaced apart conductive contact pins 50 each have tail end 73 and mating end 54. Contact pin mating ends 54 extend through receptacle contact apertures 58 (shown in FIG. 2A) into mating portion 48 upon receiving plug connector assembly 20A. Mating ends 54 are configured to engage respective mating ends 40 of the spaced apart plurality of conductive contact sockets 38.

Plug shell body 36 and receptacle shell body 46 can each be a monolithic molded article. Integral retaining ring 76 also allows the use of a monolithic plug shell body by ensuring appropriate positioning of both mating ends 40 and crimp ends 72 mostly or entirely within contact apertures 56. Many standardized and traditional connector interfaces have split metal or thermoplastic shells. In lower voltage applications, this simplifies assembling of the conductive contact pins and sockets to the shell, but even the smallest gaps increase dielectric and corona problems between adjacent contacts, particularly as operating voltages and altitudes increase.

However, monolithic molded shell bodies as used in plug shell body 36 and receptacle shell body 46 more fully shields adjacent conductive contact sockets and pins retained therein. This permits closer contact spacing without the need to leave open one or more of the contact apertures. Suitable classes of material for shell bodies includes several types of thermoplastic or thermoset polymer resin, many of which improve resistance to corrosion caused in part by salt and fog intrusion, while increasing thermal capabilities of the connector interface seen in higher current applications. The shells can also be manufactured in large quantities by any qualified molding shop, and can incorporate other off-the-shelf parts such as contact pins and sockets. Each of these aspects cooperate to reduce required dielectric and corona spacing of respective conductive contacts allowing for a smaller interface footprint without removing contacts, while also improving manufacturability and assembly.

Two non-limiting examples of suitable materials for molding and/or machining monolitihic shell bodies include poly (phenylene sulfide) and polyetherimide. Various types of poly (phenylene sulfide) are available commercially under the trade designation Ryton® by ChevronPhilips Chemical Company of The Woodlands, Tex. Polyetherimide can be reinforced with glass fibers. Various types of reinforced polyetherimide are available from multiple commercial suppliers, and sold commercially as ULTEM®. One non-limiting example of reinforced polyetherimide suitable for connector shell bodies includes ULTEM® 2300.

FIG. 2B also shows reversible anti-rotation fastener posts 28 and optional face seal 74. Optional face seal 74 is disposed between plug connector assembly 20A and board-type receptacle connector assembly 22A to further shield adjacent pairs of interconnected contact pins and sockets from dielectric and corona problems at higher operational voltages and altitudes. In certain embodiments, optional face seal 74, which may be silicone or other high-temperature electrically insulating gasket, can be disposed between a mating face of the plug mating portion and a mating face of the receptacle mating portion. In this example, face seal 74 can be secured to plug mating face 98 (shown in FIG. 3B) or receptacle mating face 99 (shown in FIG. 4B).

Figure 3B:
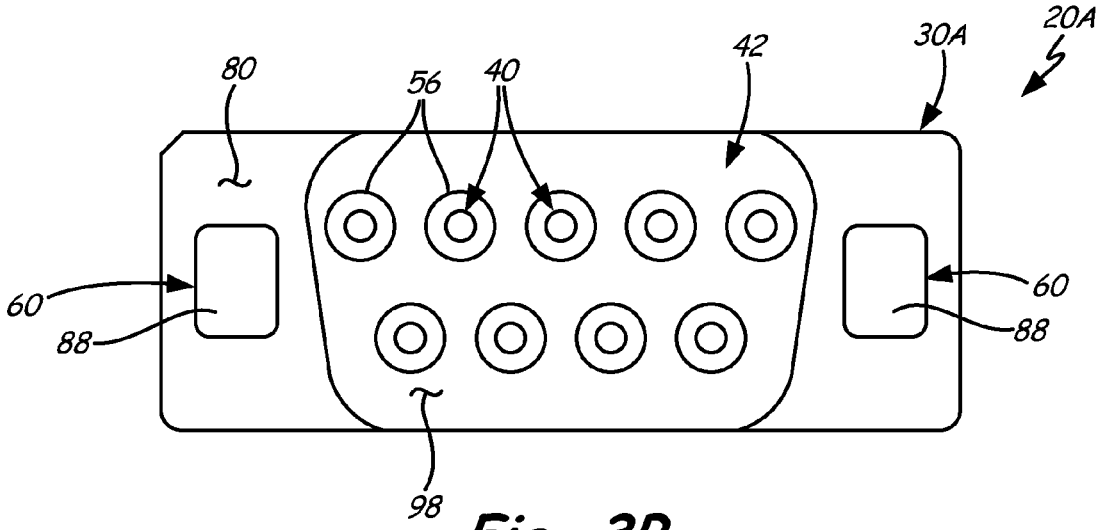
FIG. 3B is an elevation view of a mating face of the harness-type plug connector assembly shown in FIG. 3A.

In this example, anti-rotation fastener posts 28 are disposed with first fastener post receiving ends 64 inserted into a non-round portion of receptacle anti-rotation aperture 62 from inner mating side 82 of receptacle mounting flange 32A. Second rounded fastener post receiving ends 66 thus each will abut inner mating side 80 of plug mounting flange 30A proximate plug anti-rotation aperture 60. Receptacle anti-rotation apertures 62 have anti-rotation portion 84 accessible from inner mating side 82 of receptacle mounting flange 32A. As seen in FIG. 3B, plug anti-rotation apertures 60 also have non-round anti-rotation portions 88 accessible from inner mating side 80 of plug mounting flanges 30A.

Figure 2C:
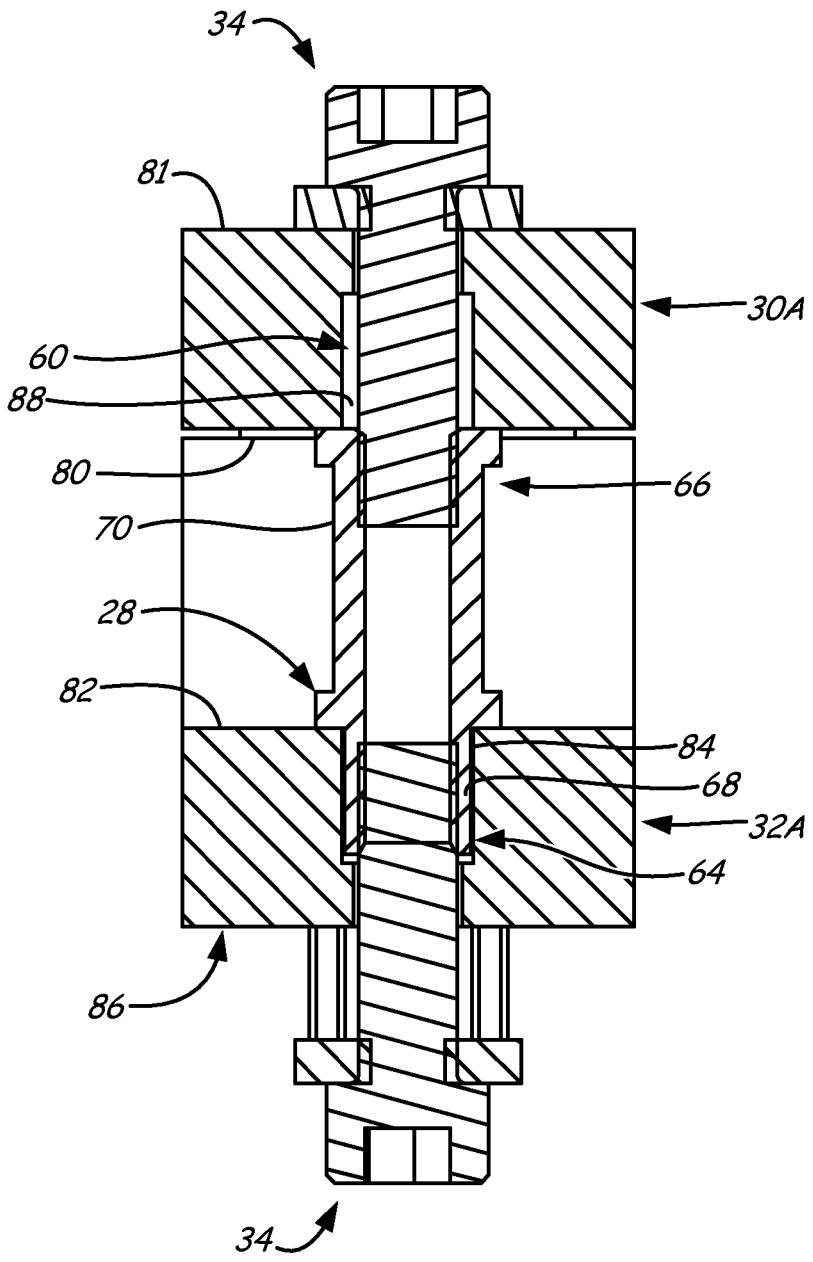
FIG. 2C depicts an anti-rotation post and fasteners used to secure an electrical connector interface.

FIG. 2C shows anti-rotation posts 28, plug mounting flange 30A, receptacle mounting flange 32A, plug connector mating portion 42, receptacle connector mating portion 48, plug anti-rotation apertures 60, receptacle anti-rotation apertures 62, first anti-rotation post fastener receiving ends 64, second fastener receiving ends 66, non-round external surface 68, round external surface 70, plug flange mating sides 80, plug flange outer sides 81, receptacle flange inner mating sides 82, anti-rotation aperture portion 84, and anti-rotation aperture portions 88.

FIG. 2C shows a cross-section of mounting flanges 30A and 32A to illustrate operation of anti-rotation posts 28. As described with respect to FIGS. 2A and 2B, plug anti-rotation apertures 60 have non-round anti-rotation portion 88 accessible from plug flange inner mating sides 80, while receptacle anti-rotation apertures 62 have non-round anti-rotation portion 84 accessible from receptacle flange inner mating sides 82. First anti-rotation post end 64 includes non-round external surface 68 which can be retained in either plug flange inner mating side 80, or receptacle flange inner mating side 82. Orientation depends in part on whether the plug and receptacle connector assemblies are harness-type or board-type.

Here, first anti-rotation post fastener receiving ends 64 are disposed in anti-rotation portion 84 of receptacle flanges 32A, while second fastener receiving ends 66 abut anti-rotation portion 88 of plug flanges 30A. In this example, second rounded fastener receiving end 66 has a larger cross-section than, and is not compatible with, non-round anti-rotation portions 88. Thus, some fasteners 34 can each be inserted into plug anti-rotation apertures 60 from a position adjacent to harness 24 (shown in FIG. 3A), through outer side 81 of plug flanges 30A. These fasteners 34 are then threaded into second round fastener receiving ends 66 of each anti-rotation fastener post 28. Another group of fasteners 34 are inserted through receptacle anti-rotation apertures 62 via outer side 86 of receptacle flanges 32A. The second set of fasteners 34 are then threaded into first non-round fastener receiving ends 64. Other embodiments may have anti-rotation fastener post 28 in a reverse configuration as shown and described below. For example, anti-rotation fastener posts 28 can be inserted with first fastener post receiving ends 64 in a reverse orientation as shown in FIG. 5, while still maintaining the ability to use standard fasteners. Fasteners 34 can be standardized #4-40 screws or other similar off-the-shelf commercially available threaded fasteners. This and other similar mounting arrangements described below permit securing of various plug and receptacle assembly combinations with standardized contact spacing and modular components. It eliminates the need for clamps or other metal retention devices which can create conductive paths external to the electrical interface. As described with respect to FIGS. 2A, 2B, and FIG. 4A, anti-rotation receptacle apertures 62 have a non-round anti-rotation section 84 accessible from receptacle flange inner mating sides 82. This non-round section of apertures 62 have a cross-section configured to receive and prevent rotation of first anti-rotation post fastener receiving ends 64. Here, fasteners 34 can be inserted through outer mating sides 86 of receptacle flanges 32A adjacent or through board 26, to engage respective first anti-rotation post fastener receiving ends 64.

Example Harness-Type Plug Connector

FIG. 3A shows a cross-section of harness-type plug connector assembly 20A, and also includes external plug mounting flanges 30A, nonconductive plug shell body 36, plug contact sockets 38, plug contact mating ends 40, plug mating portion 42, plug connector boot portion 44, plug contact apertures 56, plug anti-rotation apertures 60, crimp ends 72, integral retaining ring 76, sleeve retention ridge 78, mating side 80, anti-rotation aperture portions 88, plug flange outer sides 81, plug connector boot surface 90, tapered inner wall portion 92, plug harness wires 94, harness sleeve 96, and plug mating surface 98.

As shown in FIGS. 2A-2B, conductive contact sockets 38 are crimp-type sockets with mating end 40 and crimp end 72. Socket crimp ends 72 receive one or more conductive plug harness wires 94 for integrating plug connector assembly 20A into the circuit via harness 24. Plug connector boot portion 44, which may be integrally molded with nonconductive plug mating portion 42, at least partially shrouds respective socket crimp ends 72. To retain the position of crimp contact sockets 38 recessed below boot surface 90, plug contact apertures 56 may have a tapered inner wall portion 92 to engage retaining ring 76. To further shroud crimped connections between harness 24 and harness-type plug connector assembly 20A, harness sleeve 96 can be secured over harness wires 94 and plug connector boot portion 44. Connector boot portion 44 can also have one or more interface surfaces with optional external sleeve retention ridges 78 to improve retention of harness sleeve 96 by increasing the contact area therebetween.

Two suitable types of crimp sockets for use as contact sockets 38 are those meeting the requirements of United States Military Specification Part Numbers M39029/34 and M39029/36. Such contacts encompass standard 8, 12, 16, 20, or 22 gauge wire and socket sizes and can include optional integral retaining ring 76. It will be recognized that other larger or smaller gauge contacts can be adapted for use as well.

FIG. 3B shows plug connector assembly 20A with mating face 98 and inner mating sides 80, and also includes plug flanges 30A, plug contact mating ends 40, plug mating portion 42, contact apertures 56, plug anti-rotation apertures 60, plug flange inner mating sides 80, anti-rotation aperture portions 88, and plug mating surface 98.

In certain embodiments, contact socket mating ends 40 are recessed within monolithic mating portion 42 below plug mating surface 98 to further shroud conductive contact sockets and pins from environmental intrusion and from adjacent contacts. Optional face seal 74 (shown in FIG. 2B) may abut plug mating surface 98 to improve dielectric and corona isolation between adjacent contacts. Contact socket mating ends 40 can be recessed below plug mating face 98 to shield the connection with tail contact pin mating ends 54 (shown in FIGS. 4A-4B).

Example Board-Type Receptacle Connector

Figure 4A:
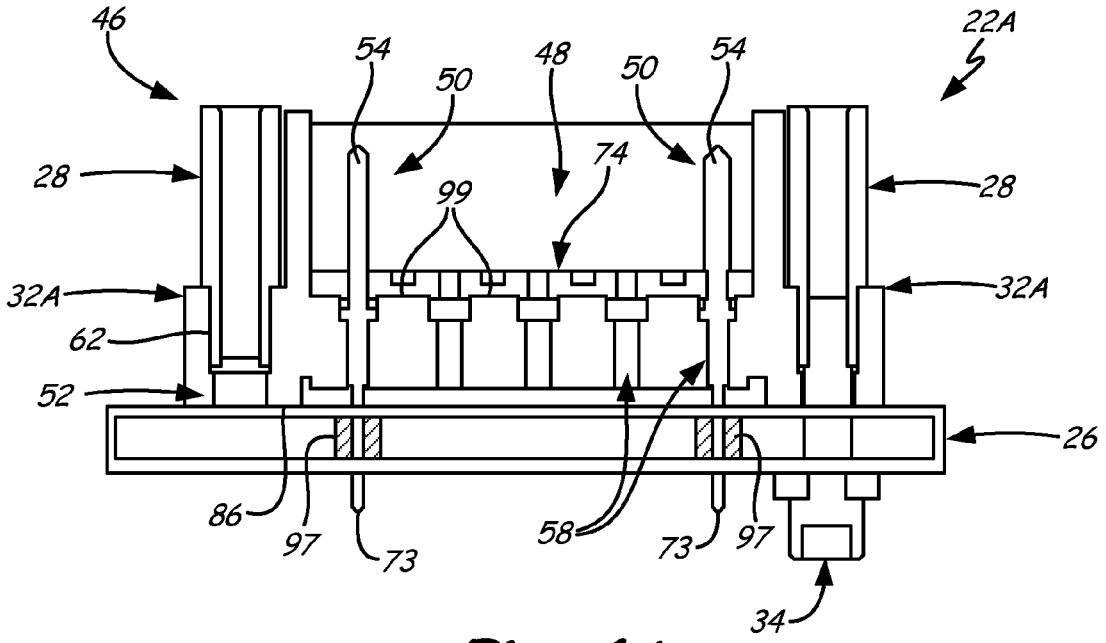
FIG. 4A is a cross-section of a board-type receptacle connector assembly forming part of the interface shown in FIGS. 2A and 2B.
Figure 4B:
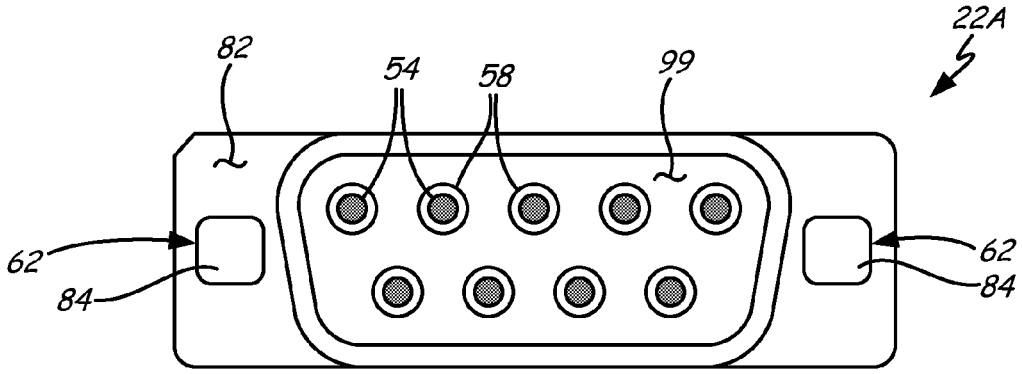
FIG. 4B is an elevation view of a mating face of the board-type receptacle connector assembly shown in FIG. 4A.
Figure 5:
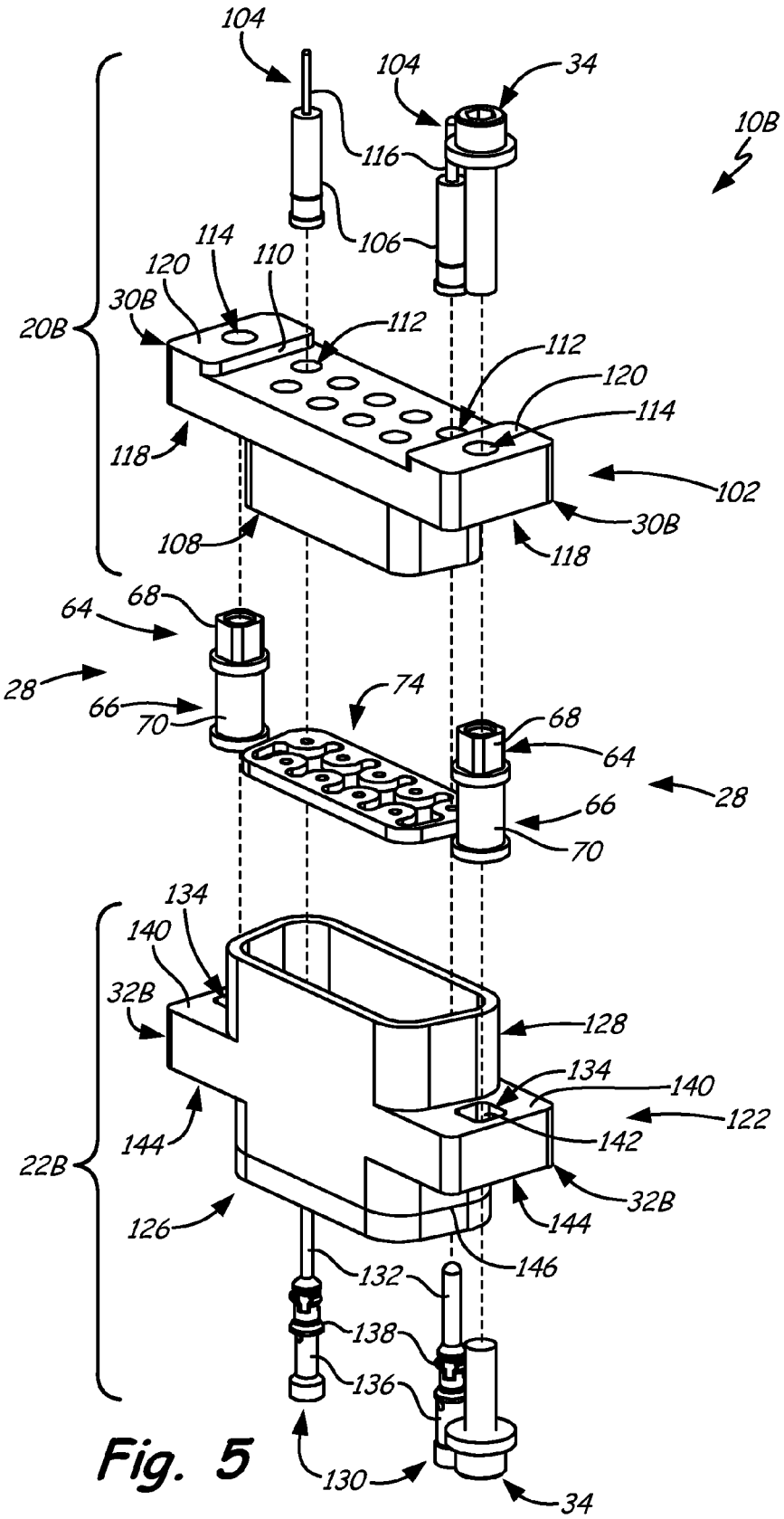
FIG. 5 depicts an exploded view of the second example electrical connector interface from FIG. 1B.

FIGS. 4A and 4B show board-type receptacle connector assembly 22A with board 26, and also includes receptacle mounting flanges 32A, board-type receptacle shell body 46, receptacle mating portion 48, standoffs 52, contact pin mating ends 54, receptacle anti-rotation apertures 62, contact pin tail ends 73, receptacle flange inner mating sides 82, anti-rotation aperture portion 84, receptacle flange outer sides 86, circuit contacts 97, and receptacle mating face 99.

Board-type receptacle connector assembly 22A may be configured to be mounted on or proximate to a substrate such as a circuit board 26. Board 26 can for example be a printed wiring board (PWB) and may include one or more integrated circuits mounted thereon. Receptacle shell body 46 also can include at least one integrally molded external mounting flange 32A with a receptacle anti-rotation aperture 62. In this example, a plurality of spaced apart conductive tail contact pins 50 each have mating end 54 extend into mating portion 48, and configured to engage respective mating ends 40 of the spaced apart plurality of conductive contact sockets 38 (shown in FIGS. 3A-3B). As a board-type connector shell, receptacle shell body 46 can also include standoffs 52 to maintain separation from board 26. Only two conductive contact pins 50 are shown; the remainder are omitted for clarity.

As shown in FIGS. 2A and 2B, conductive contact pins 50 can be tail contact pins having mating end 54 and tail end 73. Conductive contact pins 50 are retained in receptacle contact apertures 58 so that tail ends 73 extend out of shell body 46 and can be conductively connected to one or more respective conductive circuit contacts 97 disposed on board 26. Tail ends 73 can be of the press-in type for quickly and reliably integrating receptacle connector assembly 22A into the integrated circuit(s). Alternatively tail ends 73 can be soldered or otherwise conductively connected to the circuit(s) disposed on board 26.

Tail connectors suitable for use as contact pins 50 can have standardized gauge pin and tail ends (e.g., 8, 12, 16, 20, or 22 gauge). One example family of suitable tail connector pins are solderless press-fit PCB pins available from Mill-Max Mfg. Corporation of Oyster Bay, N.Y.

FIG. 4B shows board-type receptacle connector assembly 22A with receptacle flanges 32A, receptacle shell mating portion 48, contact pin mating ends 54, receptacle anti-rotation apertures 62, receptacle flange inner mating sides 82, anti-rotation aperture portion 84, and receptacle mating face 99.

As described with respect to FIGS. 2A, 2B, and FIG. 4A, anti-rotation receptacle apertures 62 have a non-round anti-rotation section 84 accessible from receptacle flange inner mating sides 82. This non-round section of apertures 62 have a cross-section configured to receive and prevent rotation of first anti-rotation post ends 64. Here, fasteners 34 can be inserted through outer mating sides 86 of receptacle flanges 32A adjacent or through board 26, to engage respective first anti-rotation post ends 64.

Spacing of receptacle contact apertures 58 (shown in FIGS. 4A and 4B) is aligned with that of plug contact apertures 56 shown in FIGS. 3A and 3B. Contact pin mating ends 54 extend into receptacle mating portion 48 from receptacle mating surface 99 to engage contact socket mating ends 40 recessed into plug mating portion 42. Optional face seal 74 (shown in FIG. 2B) may be secured to receptacle mating surface 99 to further shroud conductive contact sockets and pins from environmental intrusion and from dielectric effects therebetween.

Example Interface 10B-Board-Type Plug Connector and Harness-Type Receptacle Connector FIG. 5 shows a second example alternative connector interface 10B utilizing two other possible connector embodiments: board-type plug connector assembly 20B, and harness-type receptacle connector assembly 22B. FIG. 5 also shows anti-rotation fastener posts 28, fasteners 34, and face seal 74. Board-type plug connector assembly 20B also includes external plug mounting flanges 30B, board-type plug shell body 102, electrically conductive tail contact sockets 104, tail contact mating ends 106, board-type plug mating portion 108, plug connector standoffs 110, plug contact apertures 112, plug anti-rotation apertures 114, tail contact socket tail ends 116, plug flange inner mating sides 117, plug anti-rotation aperture inner portions 118, and plug flange outer sides 120. Harness-type receptacle connector assembly 22B also includes receptacle mounting flanges 32B, nonconductive receptacle shell body 122, receptacle connector boot portion 126, receptacle mating portion 128, contact pin mating ends 132, receptacle anti-rotation apertures 134, contact pin crimp ends 136, integral retaining rings 138, sleeve retention ridge 146, receptacle flange inner mating sides 140, receptacle anti-rotation aperture portion 142, and receptacle flange outer sides 144. Anti-rotation fastener posts 28 also include first anti-rotation post fastener receiving ends 64, second fastener receiving ends 66, non-round external surface 68, and round external surface 70.

Board type plug connector assembly 20B includes nonconductive monolithic plug shell body 102, including a plurality of spaced apart, electrically conductive tail contact sockets 104 having mating ends 106 and tail ends 116 retained in corresponding board-type plug contact apertures 112. In board type plug connector assembly 20B, plug contact apertures 112 extend through plug mating portion 108 of plug shell body 102. Board-type plug shell body 102 also has at least one integrally molded external plug mounting flange 30B with plug anti-rotation aperture 114. Only two tail contact sockets 104 are shown; the remainder are omitted for clarity. Plug shell body 102 can also include standoffs 110 to maintain separation from board 26 (shown in FIG. 6A).

Figure 6A:
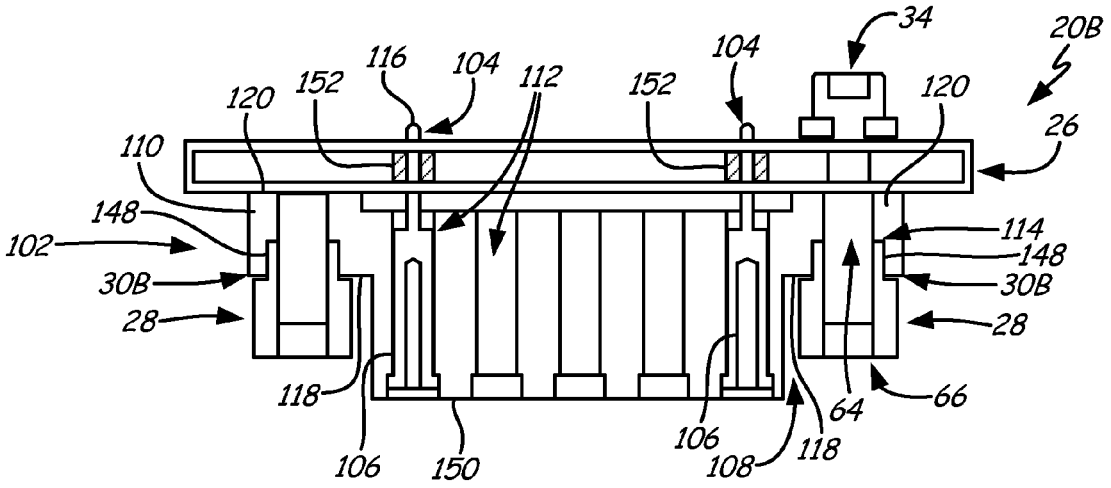
FIG. 6A is a cross-section of a board-type plug connector assembly forming part of the interface shown in FIG. 5.

Harness-type receptacle connector assembly 22B includes nonconductive receptacle shell body 122 with a plurality of spaced apart conductive contact pins 130 extending into receptacle mating portion 128, which is configured to receive plug mating portion 108 of plug shell body 102 (shown in FIGS. 5 and 6A). Each conductive contact pin 130 has mating end 132 and crimp end 136. Mating ends 132 are configured to engage respective mating ends 106 of the spaced apart plurality of conductive tail contact sockets 104 (shown in FIG. 6A). Only two conductive contact pins 130 are shown; the remainder are omitted for clarity.

Receptacle shell body 122 can include at least one integrally molded external mounting flange 32B with receptacle anti-rotation aperture 134. As a harness-type connector, receptacle shell body 122 can also include integrally molded connector boot portion 126 to help shroud interconnections with individual wires of harness 24 (shown in FIG. 7A). Optional external sleeve retention ridge 146 can improve retention of a harness shrink-sleeve, also shown in FIG. 7A, to connector boot portion 126. Contact pins 130 can also optionally include integral retaining ring 138 to prevent excessive movement of contact pins 130 once they have been installed through apertures 154.

Like harness-type plug shell body 36 and board-type receptacle shell body 46 (shown in FIGS. 2A and 2B), board-type plug shell body 102 and harness-type receptacle shell body 122 can each be a monolithic molded article to decrease the risk of dielectric and corona problems between adjacent contacts, and permit closer contact spacing without the need to remove one or more of the contacts from the shells. Integral retaining ring 138 also allows the use of a monolithic plug shell body by ensuring appropriate positioning of both mating ends 132 and crimp ends 136 mostly or entirely within contact apertures 154 without the need for a split shell. As above, the shell bodies may be integrally molded from a temperature resistant thermoplastic or thermoset polymer such as glass-reinforced polyetherimide, or poly(phenylene sulfide) to increase resistance to corrosion caused by salt and fog intrusion, as well as other operational conditions, while increasing thermal capabilities of the interface seen in higher current applications.

FIG. 5 also shows reversible anti-rotation fastener posts 28 and optional face seal 74. Optional face seal 74 is disposed between plug connector assembly 20B and receptacle connector assembly 22B to further shield adjacent pairs of interconnected contact pins and sockets from dielectric and corona problems at higher operational voltages and altitudes. In certain embodiments, optional face seal 74, which may be a silicone or other high-temperature, electrically insulating gasket, can be disposed between a mating face of the plug mating portion and a mating face of the receptacle mating portion. In this example, face seal 74 can be secured to plug mating face 150 (shown in FIG. 6B) or receptacle mating face 162 (shown in FIG. 7B).

Anti-rotation fastener posts 28 can include first fastener post receiving end 64 and opposing second receiving end 66. First receiving end 64 can have a non-round external surface 68 while second internally receiving end 66 can have round external surface 70. Similar to FIG. 2C above, both plug anti-rotation apertures 114 and receptacle anti-rotation apertures 134 each have respective non-round anti-rotation portions 118 (shown in FIGS. 6A-6B), 142, (shown in FIGS. 7A-7B) accessible from respective flange inner mating sides 117, 140. Thus, a first anti-rotation fastener post receiving end 64 is insertable into, and can be retained in, either plug mounting flange 30B or receptacle mounting flange 32B.

Here, non-round external surface 68 of first anti-rotation fastener post receiving end 64 is inserted into a non-round side of anti-rotation aperture 114 from an inner mating side 117 of receptacle flange 32A. In this example, second rounded fastener post receiving end 66 has a larger cross-section than, and is not compatible with, anti-rotation aperture 134 on inner mating side 140 of receptacle mounting flange 32B. In this orientation, one set of fasteners 34 can be inserted through receptacle flanges 32B via outer side 144 of receptacle anti-rotation apertures 134. Fasteners 34 are then threaded into second round fastener post receiving ends 66 of each anti-rotation fastener post 28. A second set of fasteners 34 are inserted through plug flanges 30B via outer side 120 of plug anti-rotation apertures 114. Fasteners 34 are then threaded into first non-round fastener post receiving ends 64. Thus with the receptacle connector assembly being a harness connector assembly and the plug connector assembly being a substrate connector assembly, the non-round external surface of the anti-rotation post can be inserted into the inner mating side of at least one plug mounting flange. This can be done to better stabilize a connection of a harness-type receptacle to a board-type plug, as compared to the reverse configuration of a harness-type plug connector and a board-type receptacle connector as shown in the preceding example 10A. Connections can be made using standard fasteners 34 as described above to allow securing of various plug and receptacle assembly combinations using a standardized interface with modular components, while eliminating the need for clamps or other metal retention devices which can create conductive paths external to the electrical interface.

Example Board-Type Plug Connector

Figure 6B:
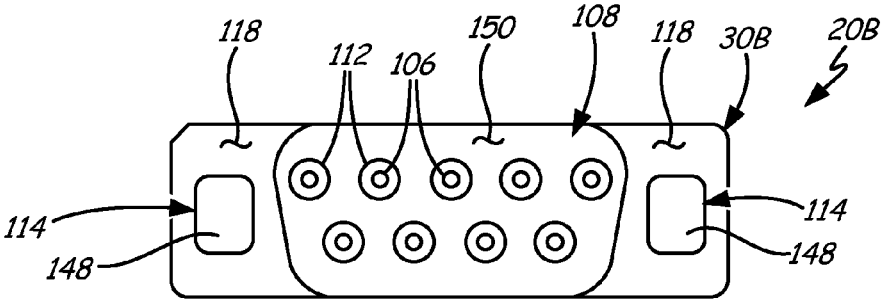
FIG. 6B is an elevation view of a mating face of the board-type plug connector assembly shown in FIG. 6A.

FIGS. 6A and 6B show board-type plug connector assembly 20B, and also includes external plug mounting flanges 30B, nonconductive plug shell body 102, electrically conductive tail contact sockets 104, tail socket mating ends 106, board-type plug mating portion 108, plug connector standoffs 110, plug contact apertures 112, plug anti-rotation apertures 114, contact socket tail ends 116, plug flange mating sides 117, anti-rotation aperture portions 118, plug flange outer sides 120, plug mating face 150, and circuit contacts 152.

Board-type plug connector assembly 20B may be configured to be mounted on or proximate to a substrate such as a circuit board or printed wiring board (PWB) 26. Board-type plug assembly 20B includes nonconductive plug shell body 102 with monolithic plug mating portion 108. Plug shell body 102 also can include at least one integrally molded external mounting flange 30B. As a board-type connector, plug shell body 102 can also include standoffs 110 to maintain separation from board 26.

As shown in FIG. 5, conductive contact sockets 104 can be tail contact sockets having mating end 106 and tail end 116. Tail socket mating ends 106 can be recessed below plug mating face 150 to shield the connection when receiving respective pin mating ends 132 (shown in FIGS. 7A and 7B). Conductive contact sockets 104 are retained in plug contact apertures 112, which extend through plug mating portion 108 so that tail ends 116 extend out of plug shell body 102. Tail ends 116 can be conductively connected to one or more respective conductive circuit contacts 152 disposed on board 26. Tail ends 116 can be of the press-in type for quickly and reliably integrating plug connector assembly 20B into the circuit(s) fixed or printed onto board 26. Alternatively tail ends 116 can be soldered or otherwise conductively connected to the circuit(s) disposed on board 26.

One suitable type of tail connector for use as contact sockets 104 can have standardized gauge pin and tail ends (e.g., 8, 12, 16, 20, or 22 gauge). One example family of suitable tail connector pins are solderless press-fit PCB sockets available from Mill-Max Mfg. Corporation of Oyster Bay, N.Y.

FIG. 6B shows board-type plug connector assembly 20B with plug mating face 150 and inner mating sides 117 of receptacle flanges 30B. As described with respect to FIG. 5 and FIG. 6A, anti-rotation receptacle apertures 114 have a non-round anti-rotation section 118 accessible from receptacle flange inner mating sides 117. This non-round section of apertures 114 have a cross-section configured to receive and prevent rotation of first anti-rotation post fastener receiving ends 64. Here, fasteners 34 can be inserted through outer mating sides 120 of receptacle flanges 32A adjacent or through board 26, to engage respective first anti-rotation post receiving ends 64.

The spacing of contact apertures 112 is reduced through use of a monolithic shell body, including mating portion 108. Contact socket mating ends 106 are recessed into plug mating portion 108 from receptacle mating surface 150 to shroud the interface with contact pin mating portions 130 (shown in FIG. 7A). Optional face seal 74 (shown in FIG. 5) may be secured to receptacle mating surface 162 to further shroud conductive contact sockets and pins from environmental intrusion and from the dielectric effects between adjacent contacts.

Example Harness-Type Receptacle Connector

Figure 7A:
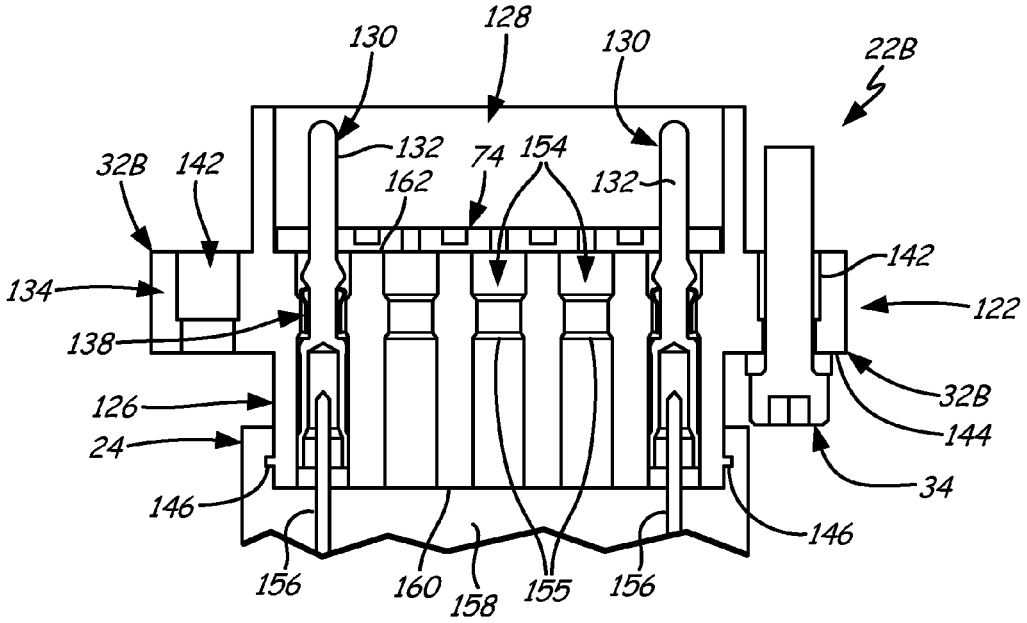
FIG. 7A is a cross-section of a harness-type receptacle connector assembly forming part of the interface shown in FIG. 5.

FIG. 7A shows harness-type receptacle connector assembly 22B, and also includes harness 24, receptacle mounting flanges 32B, nonconductive receptacle shell body 122, receptacle connector boot portion 126 receptacle mating portion 128, contact pin mating ends 132, receptacle anti-rotation apertures 134, contact pin crimp ends 136, integral retaining rings 138, sleeve retention ridge 146, receptacle flange inner mating sides 140, anti-rotation aperture portion 142, receptacle flange outer sides 144, tapered inner aperture wall 155, harness wires 156, harness sleeve 158, boot surface 160, and receptacle mating face 162.

Receptacle connector assembly 22B is configured to receive mating portion 108 of plug shell body 102. As seen in FIG. 5, contact pins 130 are crimp-type pins with mating end 132 and crimp end 136. Crimp ends 136 receive one or more conductive harness wires 156 for integrating receptacle connector assembly 22B into the circuit via spaced apart, conductive contact pins 130 as shown in FIG. 3A. Connector boot portion 126, which may be integrally molded with nonconductive receptacle mating portion 128, at least partially shrouds respective crimp ends 136, and may be completely recessed below boot surface 160. To retain position of contact pins 130, contact apertures 154 may have tapered inner wall 155 to engage retaining ring 138. To shroud crimped connections to harness 24, sleeve 158 can be secured over boot surface 160. Connector boot portion 126 can also have optional sleeve retention ridges 146 to improve retention of harness sleeve 158 by increasing the contact area therebetween.

Two suitable types of crimp pins are those meeting requirements of United States Military Specification Part Numbers M39029/34 and /36. Such contacts encompass standard 8, 12, 16, 20, or 22 gauge wire and socket sizes and can include optional integral retaining ring 138. It will be recognized that other larger or smaller gauge contacts can be adapted for use as well with appropriate contact spacing.

Figure 7B:
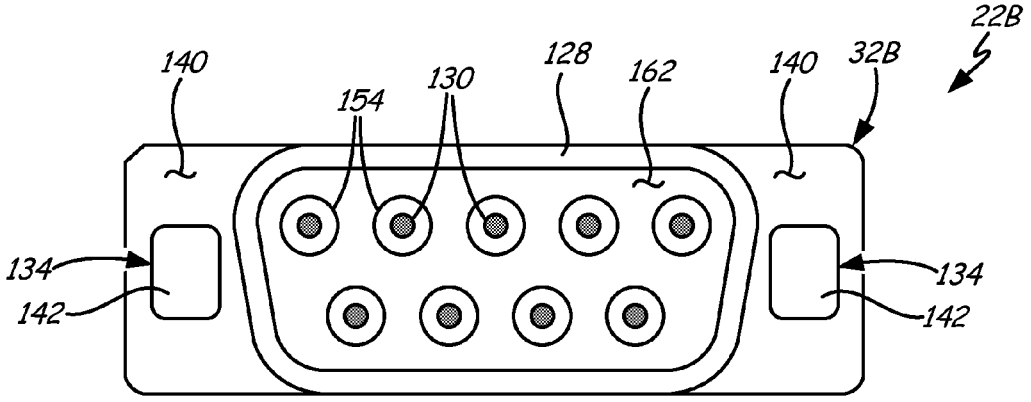
FIG. 7B is an elevation view of a mating face of the harness-type receptacle connector assembly shown in FIG. 7A.

FIG. 7B shows harness-type receptacle connector assembly 22B with receptacle mating face 162 and inner mating sides 140 of receptacle flanges 32B, and also includes receptacle mating portion 128, contact pin mating ends 132, receptacle anti-rotation apertures 134, receptacle flange inner mating sides 140, anti-rotation aperture portion 142, and receptacle mating face 162.

As described with respect to FIG. 5 and FIG. 7A, anti-rotation receptacle apertures 134 have a non-round section 142 accessible from receptacle flange inner mating sides 140. This non-round section of apertures 142 have a cross-section configured to receive and prevent rotation of first anti-rotation post fastener receiving ends 64. However, in this example, first anti-rotation post fastener receiving ends 64 are inserted in anti-rotation receptacle apertures 114 from plug flange inner mating sides 117 as shown in FIG. 5 and FIG. 6A. Here, fasteners 34 can be inserted through outer mating sides 144 of receptacle flanges 32B, adjacent to harness 24, in order to engage respective second post ends 66.

The spacing of contact apertures 154 are aligned with that of contact apertures 112 shown in FIGS. 6A and 6B. Contact pin mating ends 132 extend into receptacle mating portion 128 from receptacle mating surface 162 to engage tail socket mating ends 106 recessed into plug mating portion 108 as shown in FIG. 5. Optional face seal 74 (shown in FIG. 5) may be secured to receptacle mating surface 162 to further shroud conductive contact sockets and pins from environmental intrusion and reduce dielectric effects between adjacent contacts.

Figure 8A:
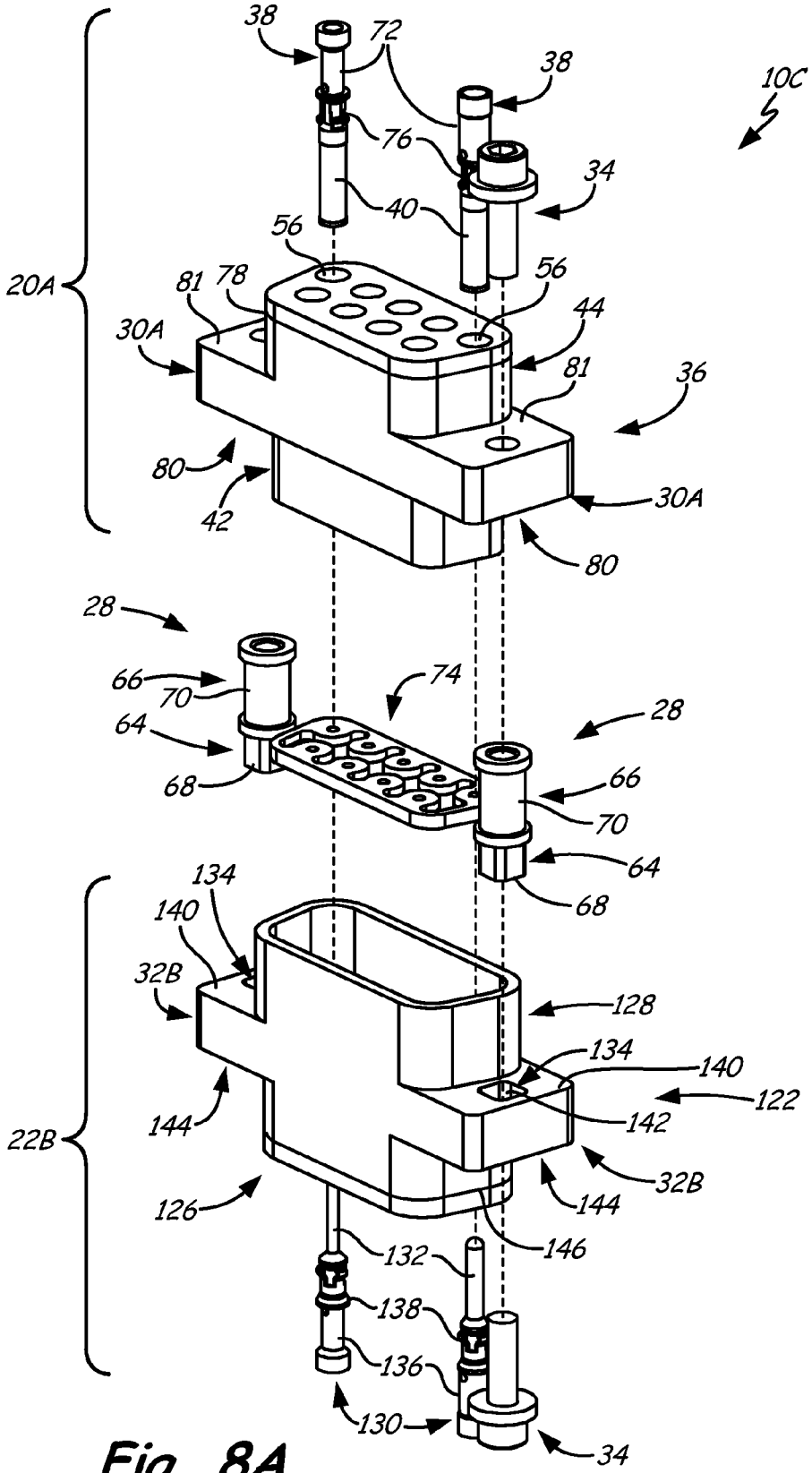
FIG. 8A includes an exploded view of the third example electrical connector interface from FIG. 1C.
Figure 8B:
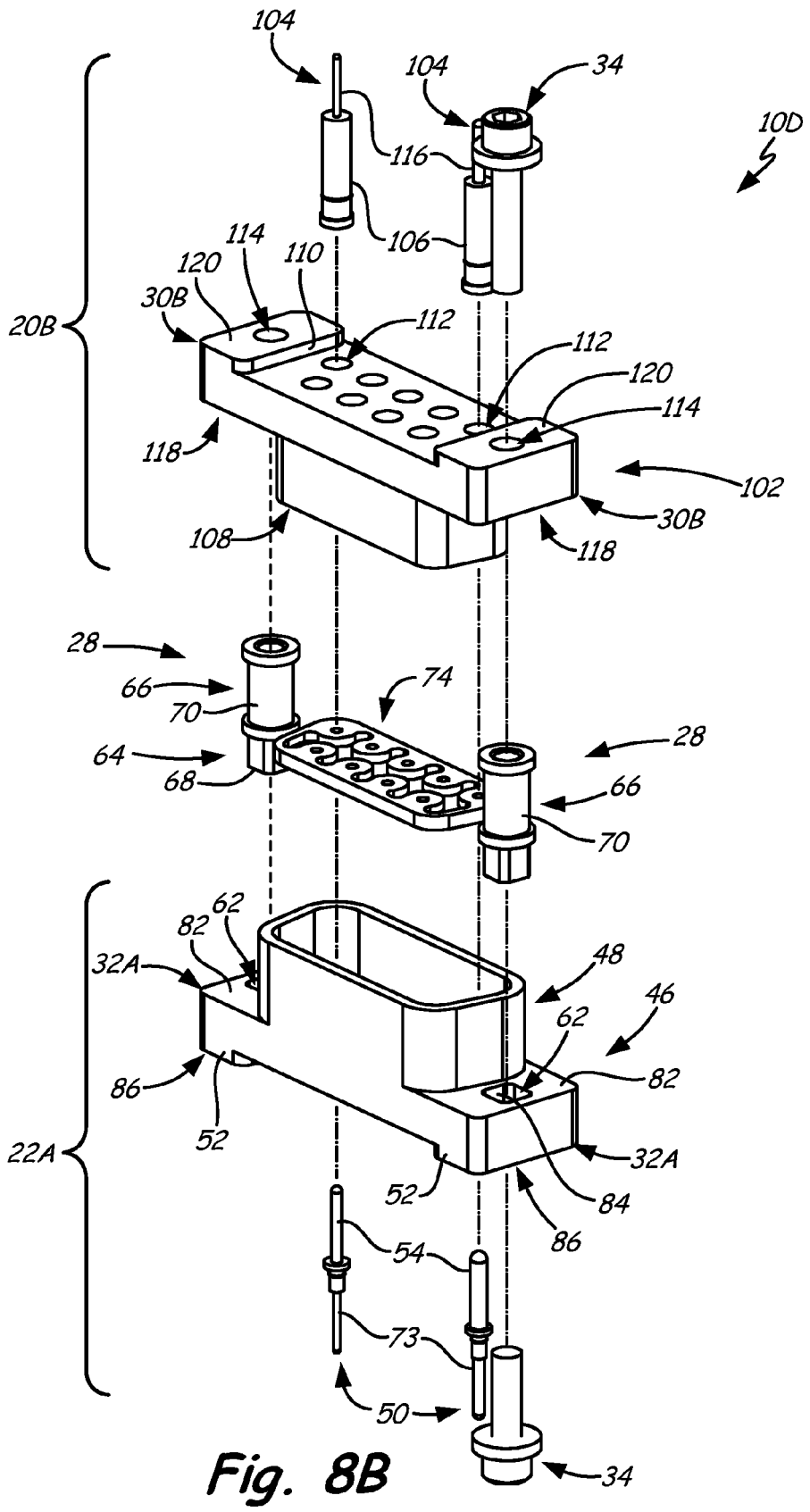
FIG. 8B depicts an exploded view of the fourth example electrical connector interface from FIG. 1D.

The preceding example interface assemblies 10A and 10B have shown two combinations of a total of four different types of connector assemblies: harness-type plug connector assembly 20A (shown in FIGS. 3A and 3B), board-type receptacle connector assembly 22A (shown in FIGS. 4A and 4B), board-type plug connector assembly 20B (shown in FIGS. 6A and 6B), and harness-type receptacle connector assembly 22B (shown in FIGS. 7A and 7B). FIG. 8A shows a third possible interface combination including harness-type plug connector assembly 20A and harness-type receptacle connector assembly 22B. FIG. 8B shows a fourth possible interface combination 10D with board-type plug connector assembly 20B and board-type receptacle connector assembly 22A.

Example Interface 10C-Harness-Type Plug Connector and Harness-Type Receptacle Connector FIG. 8A is an exploded view of example electrical interface 10C with harness-type plug connector assembly 20A and harness-type receptacle connector assembly 22B. Harness-type plug connector assembly 20A includes molded plug shell body 36 and contact sockets 38 as shown and described with respect to FIGS. 3A-3B, while harness-type receptacle connector assembly 22B includes molded receptacle shell body 122 and contact pins 130 as shown and described with respect to FIGS. 7A-7B. Both harness-type plug connector assembly 20A and harness-type receptacle connector assembly 22B can utilize the same elements shown in detail above. In this example, anti-rotation posts 28 are shown with first non-round fastener receiving ends 64 engaged with receptacle flanges 32B. However, it will be appreciated that first non-round fastener receiving ends 64 can alternatively be engaged with plug flanges 30A.

Example Interface 10D-Board-Type Plug Connector and Board-Type Receptacle Connector FIG. 8B is an exploded view of example electrical interface 10D with board-type plug connector assembly 20B and board-type receptacle connector assembly 22A. Board-type plug connector assembly 20B includes molded plug shell body 102 and contact sockets 104 as shown in FIGS. 6A-6B, while board-type receptacle connector assembly 22A includes molded receptacle shell body 46 and contact pins 50 as shown in FIGS. 4A-4B. Both board-type plug connector assembly 20B and board-type receptacle connector assembly 22A can utilize the same elements as shown in detail above. In this example, anti-rotation posts 28 are shown with first non-round fastener receiving ends 64 engaged with receptacle flanges 32A. However, it will be appreciated that first non-round fastener receiving ends 64 can alternatively be engaged with plug flanges 30B.

The above-described connector interfaces and assemblies have demonstrated improved performance and reliability over existing standardized and other custom electrical interface solutions. This interface family can utilize off-the-shelf electrical contacts retained in monolithic resin shells to virtually eliminate dielectric breakdown and coronas in aircraft electrical systems even at today's higher elevations and voltages. Standard threaded fasteners can be used in conjunction with reversible anti-rotation posts to tightly secure the plug and receptacle assemblies together without the need for clamps that can provide an unwanted external conductive path between the harnesses and/or boards onto which the respective connector assemblies are installed. With off-the-shelf contacts and fasteners, the monolithic resin shells and the anti-rotation posts can be formed in high volume by any competent molding shop, rather than resorting to a specialized connector shop.

In certain embodiments, the spacing between respective center lines and edges of each adjacent contact is suitable for minimum sustained 200 V operation without corona or dielectric breakdown at or above a 45,000 ft atmosphere. Exact spacing will depend on the size of the wiring, contacts, and interconnects, as well as expected average and peak voltages, currents, altitudes, and other expected environmental conditions. In any case, the inter-contact spacing is less than comparable plug and receptacle interfaces originally designed for lower operating altitudes and voltages in older aircraft. To adapt these older interfaces (such as 28 VDC and 115 Vrms) for more modern aircraft systems, one or more contacts needs to be removed to sufficiently prevent problems with dielectric breakdown and coronas at higher altitudes and voltages. This is because no existing interface family for aircraft electrical systems are known to utilize the above-described combinations of connector geometry, materials, and components that can be standardized throughout an aircraft.

Figure 9A:
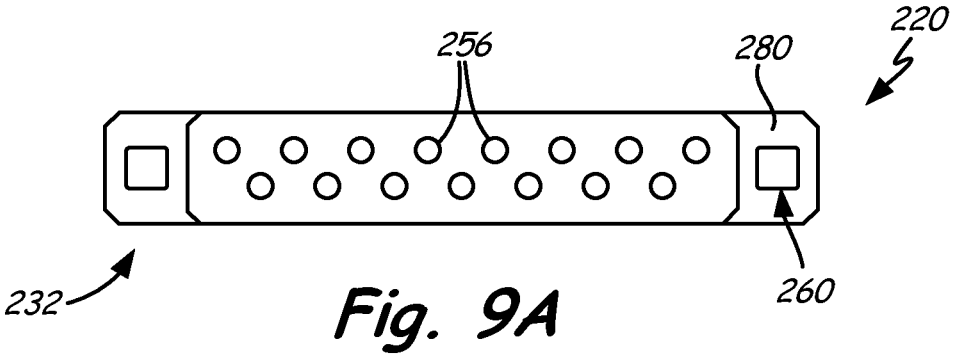
FIG. 9A shows a contact arrangement for a first alternative example electrical interface family.
Figure 9B:
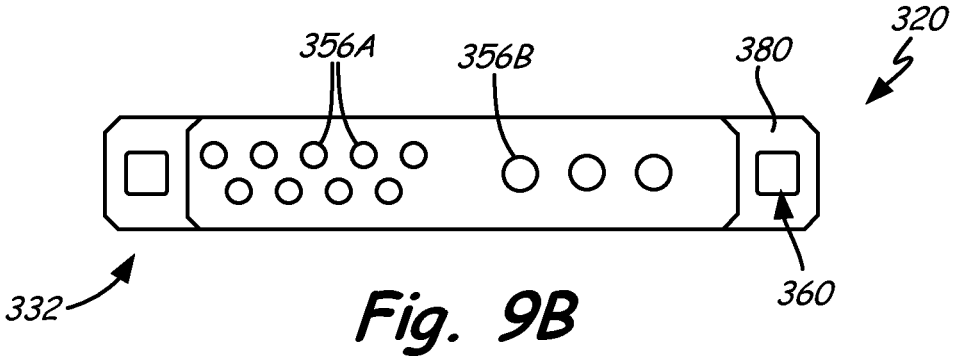
FIG. 9B depicts a contact arrangement for a second alternative example electrical interface family.
Figure 9C:
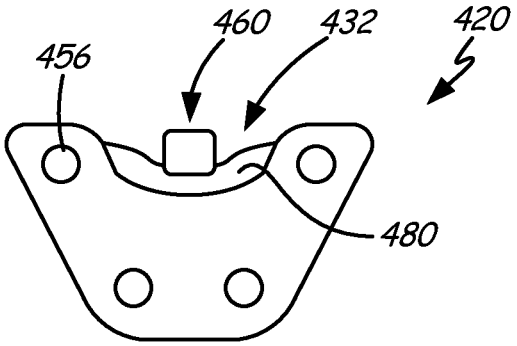
FIG. 9C is a contact arrangement for a third alternative example electrical interface family.

The above-described example family of connector interfaces included contacts spaced in a first row of five contacts and a second row of four contacts. FIGS. 9A-9C depict other contact spacing arrangements.

Alternative Electrical Contact Arrangements

FIG. 9A shows a mating face of a connector assembly 220 for a first alternative example interface family. Here, contact apertures 256 are arranged in a 15-pin configuration similar to the 9-pin arrangement shown in FIGS. 1-8. Contact apertures 256 each retain a contact pin or socket depending on the type of connector assembly (e.g., harness- or board-type, and plug or receptacle) such as those shown and described with respect to example electrical interface family 10. Connector assembly 220 also includes flanges 232 with anti-rotation apertures 260 therethrough, and accessible from inner mating side 280 of flanges 232.

FIG. 9B shows a mating face of a connector assembly 320 for a second alternative example electrical interface family. Here, one set of connector apertures 356A are arranged in a 9-pin configuration similar to that shown in FIGS. 1-8. This family also includes connector apertures 356B, which are larger gauge and thus spaced farther apart from one another than are connector apertures 356A. Contact apertures 356A, 356B each retain a contact pin or socket depending on the type of connector assembly (e.g., harness- or board-type, and plug or receptacle) such as those shown and described with respect to example electrical interface family 10A-10D. Connector assembly 320 also includes flanges 332 with anti-rotation apertures 360 therethrough, and accessible from inner mating side 380 of flanges 332.

FIG. 9C shows a mating face of a connector assembly 420 for a third alternative example electrical interface family. Here, connector apertures 456 are arranged in a 4-pin configuration around a single mounting flange 432. Contact apertures 456 each retain a contact pin or socket depending on the type of connector assembly (e.g., harness- or board-type, and plug or receptacle) such as those shown and described with respect to example electrical interface family 10A-10D. Flange 432 has anti-rotation aperture 460 therethrough, accessible from inner mating side 480 of flange 432.

It can be seen from the above examples that the connector interfaces need not have a single size contact throughout. However, since they use commonly available standardized contacts and fasteners, a common set of design rules for contact spacing can be adapted for use throughout an aircraft or other electrical system. To form any of these alternatives, the shells can be molded according to the desired type (e.g. harness/plug, harness/receptacle, board/plug, or board/receptacle). Each shell can also have a required number of integrally molded flanges. Anti-rotation apertures are formed through each flange to accept reversible posts, which also may be molded resin. Contact apertures are formed in each shell according to the above type and appropriate contact size(s), with or without a tapered wall to accept integral retaining rings on crimp contacts. The contacts are inserted through the corresponding contact apertures and secured to the respective harness or board as shown above. To engage the components, the post is placed in a suitable orientation, the plug and receptacle are engaged, and the fasteners are threaded in place.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An electrical connector interface comprising:

a plug connector assembly including a plurality of spaced apart conductive contact sockets, each contact socket having a mating end retained in a monolithic mating portion of a nonconductive plug shell body, the nonconductive plug shell body having an external mounting flange with a plug anti-rotation aperture;

a receptacle connector assembly including a plurality of spaced apart conductive contact pins extending into a mating portion of a nonconductive receptacle shell body, each conductive contact pin having a mating end configured to engage respective mating ends of the spaced apart plurality of conductive contact sockets, the nonconductive receptacle shell body having an external mounting flange with a receptacle anti-rotation aperture; and an anti-rotation fastener post with a first fastener receiving end opposite a second fastener receiving end, the first fastener receiving end insertable into the plug mounting flange in a second post orientation and the receptacle mounting flange in a first post orientation.

2. The interface of claim 1, wherein the first fastener receiving end includes a non-round external surface insertable into an inner mating side of the plug anti-rotation aperture in the second post orientation, and the receptacle anti-rotation aperture in the first post orientation.

3. The interface of claim 1, further comprising a face seal disposed against a mating face of at least one of: the plug connector assembly, and the receptacle connector assembly.

4. The interface of claim 1, wherein the contact socket mating ends are recessed below a plug mating face.

5. The interface of claim 1, wherein at least one of the plug connector assembly and the receptacle connector assembly is a harness-type connector assembly.

6. The interface of claim 5, further comprising a connector boot portion shrouding interconnection a plurality of harness wires to the harness-type connector assembly.

7. The interface of claim 5, wherein at least one of the plurality of contact sockets includes an integral retaining ring.

8. The interface of claim 5, wherein the connector boot portion includes an external retention ridge, and is integrally molded with the nonconductive shell body.

9. The interface of claim 1, wherein at least one of the plug connector assembly and the receptacle connector assembly is a board-type connector assembly for mounting to a substrate.

10. The interface of claim 9, wherein the plug mounting flange includes a standoff portion for spacing the shell mating portion apart from the substrate.

11. The interface of claim 1, wherein the first fastener receiving end is retained in the inner mating side of the receptacle mounting flange.

12. The interface of claim 1, wherein the first fastener receiving end is retained in the inner mating side of the plug mounting flange.

13. The interface of claim 12, wherein the receptacle connector assembly is a harness-type connector assembly and the plug connector assembly is a board-type connector assembly.

14. A harness-type connector assembly comprising:

a nonconductive, monolithic shell body including a connector mating portion, a connector boot portion, and an external mounting flange;

a plurality of spaced apart contact apertures extending through the connector boot portion for retaining corresponding ones of a plurality of conductive crimp contacts; and an anti-rotation aperture formed through the external mounting flange, an inner mating side of the anti-rotation aperture configured to receive a first fastener receiving end of an anti-rotation fastener post.

15. The harness-type connector assembly of claim 14, wherein the connector mating portion defines one of: a plug mating portion, and a receptacle mating portion.

16. The harness-type connector assembly of claim 14, wherein the corresponding ones of the plurality of conductive crimp contacts each includes a crimp end recessed below a connector boot surface.

17. The assembly of claim 16, wherein at least one of the plurality of conductive crimp contacts includes an integral retaining ring engaging a tapered wall of the corresponding contact aperture.

18. The harness-type connector assembly of claim 14, further comprising a face seal secured to a mating face of the connector mating portion.

19. A board-type connector assembly comprising:

an nonconductive, monolithic shell body including a connector mating portion, a standoff portion for spacing the connector mating portion apart from a substrate, and an external mounting flange;

a plurality of spaced apart contact apertures extending through the shell body for retaining corresponding ones of a plurality of conductive tail contacts; and an anti-rotation aperture formed through the external mounting flange, an inner mating side of the anti-rotation aperture configured to receive a first fastener receiving end of an anti-rotation fastener post.

20. The board-type connector assembly of claim 19, wherein the connector mating portion defines one of: a plug mating portion, and a receptacle mating portion.

21. The board-type connector assembly of claim 19, further comprising a face seal secured to a mating face of the connector mating portion.

* * * * *